United States Patent [19]

Guendling, Jr.

[11] Patent Number: 4,544,161

[45] Date of Patent: Oct. 1, 1985

[54] TRAINING AID FOR HITTING GOLF BALL

[76] Inventor: Fred W. Guendling, Jr., 19904 Center St., Box 443, Mokena, Ill. 60448

[21] Appl. No.: 632,501

[22] Filed: Jul. 19, 1984

Related U.S. Application Data

[63] Continuation of Ser. No. 490,817, May 2, 1983, abandoned.

[51] Int. Cl.[4] ..... A63B 69/36

[52] U.S. Cl. ..... 273/187 A; 273/32 H

[58] Field of Search ..... 273/187 R, 187 A, 187 B, 273/32 H, 195, 208, 205, 210; 434/252

[56] References Cited

U.S. PATENT DOCUMENTS

| | | | |
|---|---|---|---|
| 3,300,219 | 1/1967 | Sipos | 273/187 R |
| 3,887,193 | 6/1975 | Stanley | 273/187 R X |
| 4,208,053 | 6/1980 | Farr | 273/187 A X |
| 4,384,718 | 5/1983 | Cachola | 273/187 R |

*Primary Examiner*—George J. Marlo

*Attorney, Agent, or Firm*—Ernest Kettelson

[57] ABSTRACT

A golf ball positioning device comprising a T-shaped member, having a cross-arm with spaced apart holes to receive a golf tee through any selected hole, and an elongated leg extending from said cross-arm a distance substantially equal to the distance a golfer stands from the ball. The elongated leg includes spaced apart markings to enable the golfer to note and adjust his distance from the ball. The golf tee is moved forward of the center-most hole of the cross-arm to compensate for hitting the ball too high which usually results in a slice to the right, and the tee is moved rearward of the center-most hole to compensate for hitting the ball too low which usually results in a hook to the left. Anchor pins are provided at each opposite end of the cross-arm and at the free end of the leg to anchor the device securely in place on the ground.

6 Claims, 13 Drawing Figures

TRAINING AID FOR HITTING GOLF BALL

This is a continuation of application Ser. No. 490,817 filed May 2, 1983, now abandoned.

BACKGROUND OF THE INVENTION

This invention relates to the field of golf ball positioning devices or training aids to help a golfer perfect his swing and to correct any problems he has in hitting and driving a golf ball.

A number of such devices are known to the prior art, but most of them are relatively complex, too cumbersome to carry along while actually playing the game, unduly interfere with the golfer's swing, provide only limited positioning guidance, and lack means to quickly and securely anchor in a set position for the golfer to use as he actually plays the game. Representative samplings of such prior art devices are disclosed in the following U.S. patents: No. 3,992,013 which comprises a mat on which a golf ball's position can be marked; No. 3,300,219 comprising an elongated leg projecting outwardly from between shoe guides to adjust the distance of ball placement from where the golfer is standing: No. 3,229,981 comprising a rather complex foot and ball positioning device; No. 3,141,675 which discloses still a different kind of ball and foot positioning device; No. 2,189,613 comprising a platform having foot plates which are adjustable, and No. 2,025,519 comprising a foldable ruler kind of device to help a golfer measure and gauge his stance.

The present invention solves many of the problems which remain as far as prior art devices of this kind are concerned. It is very uncomplicated both to make and to use. It is very light weight. It is very thin and flat, easily carried by a golfer as he plays the course, easily stowable in a golf bag with the clubs and other golfing equipment. It lies flat on the ground, in the same plane as the surface of the ground, resulting in almost no interference with a golfer's normal swing. Yet it has triangularly positioned anchor pins or spikes to anchor securely in place for use, while being easily picked up and removed from the ground after use for carrying to the next hole or for storing after play or practice. It provides not only adjustable positioning and measurement of the distance the golfer stands from the ball, but in addition provides adjustable positioning of the ball itself forwardly and rearwardly of where the golfer stands to correct such things as slices and hooks, topping the ball, or getting too much lift.

SUMMARY OF THE INVENTION

It is an object of the invention to provide a golf ball positioning device comprising a T-shaped member of thin planar cross-sectional dimension, to lie substantially flat on the ground in substantially coplanar relationship with the surface of the ground, having means thereon to adjust the position of the golf ball forwardly and rearwardly of the golfer's stance, and to adjust the distance of the golfer from the ball.

It is an object of the invention to provide a golf ball positioning device comprising a T-shaped member having a plurality of holes in spaced apart relationship at pre-measured intervals across the cross arm of the T-shaped member, such holes being of large enough diameter to receive a golf tee therethrough.

It is an object of the invention to provide a golf ball positioning device comprising a T-shaped member having markings on its elongated leg, such elongated leg having a length substantially equal to the distance a golfer would normally stand from a golf ball when in position to swing, the markings on said elongated leg being spaced apart at predetermined intervals to enable a golfer to adjust to different distances from the golf ball and note such distance by said markings as he experiments to find the correct distance for his particular swing.

It is an object of the invention to provide a method of positioning a golf ball properly relative to the stance of the golfer, both in terms of positioning the golf ball forwardly or rearwardly with reference to the position of the golfer, to find the right position for each golfer to make a proper drive and to correct any problem the golfer may have with hitting and driving the golf ball.

It is an object of the invention to provide a golf ball positioning device comprising a T-shaped member wherein the elongated leg thereof is relatively wide and includes a panel thereon for advertising material.

It is an object of the invention to provide a golf ball positioning device comprising a T-shaped member, anchoring spikes at each opposite end of the cross-arm of the T, and an anchoring spike at the free end of the elongated leg of the T, to provide a triangularly positioned anchoring assembly to securely anchor the device to the ground and to prevent movement of said device relative to the ground when in use by a golfer driving a golf ball off of a tee placed through a positioning hole of said device.

DESCRIPTION OF PREFERRED EMBODIMENT

Figure 1:
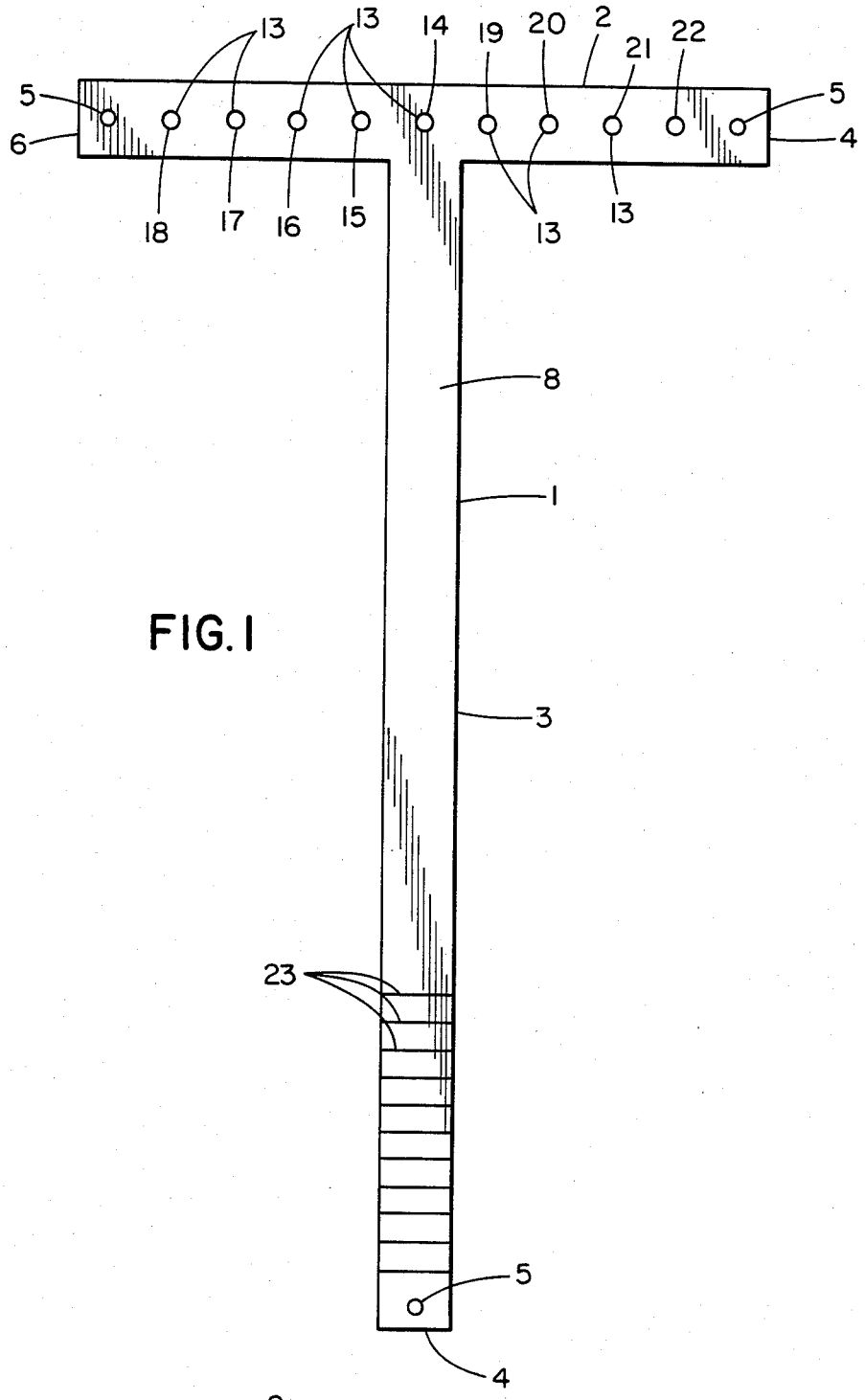
FIG. 1 is a plan view of golf ball positioning device in accordance with this invention.
Figure 2:
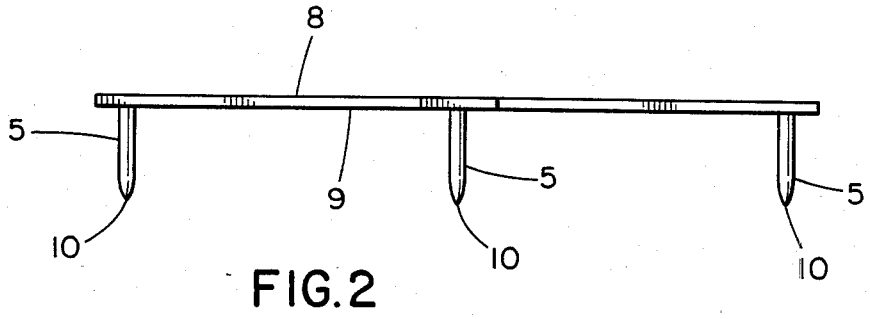
FIG. 2 is an end elevation view of the golf ball positioning device shown in FIG. 1 looking from the free end of the elongated leg of the T-shaped member.

A golf ball positioning device in accordance with this invention includes a T-shaped member 1, having a cross-arm 2 and an elongated leg 3 extending from the midpoint of cross-arm 2 and terminating at its free end 4.

The T-shaped member 1 is preferably of thin cross-section, and flat so as to lie flat on the ground and substantially coplanar with the surface of the ground. It may be of metal such as aluminum, or of plastic, wood or other appropriate material that will hold its shape.

Three anchor pins or spikes 5 are secured to the T-shaped member 1, at each opposite end 6 and 7 of the cross-arm 2 and at the free end 4 of the elongated leg 3. The anchor pins may be permanently welded or otherwise permanently secured, or they may be threaded screws having a flat head which does not project above the upper surface 8 of the T-shaped member, seated in countersunk holes and secured by flat nuts tightened against the lower surface 9 of the T-shaped member. The anchor pins 5 taper to a sharp point 10 to enable piercing and penetrating easily into the ground whe pressed downwardly to securely anchor the T-shaped member to the ground for use by a golfer, and to hold it from movement relative to the ground when the golfer hits a golf ball 11 from a tee 12 placed through one of the positioning holes 13 spaced apart at pre-measured intervals across the cross-arm 2.

The invention is not limited to any particular size of cross-arm 2, or leg 3, nor to any particular number of positioning holes 13 across the cross-arm 2. However, for purposes of describing a specific embodiment of the invention, the cross-arm 2 may be about ten inches across and the elongated leg may be about forty-four inches in length, which is about the distance a golfer would normally stand from the golf ball when in position to swing. A total of nine positioning holes 13 are provided in the embodiment shown and described herein, including a center positioning hole 14, four forward positioning holes designated by the reference numbers 15, 16 17 and 18, and four rearward positioning holes designated by the reference numbers 19, 20, 21 and 22. The positioning holes 13 have a large enough diameter to accept a tee 12 through the holes, such as for example three-sixteenths inch diameter.

The leg 3 of the T-shaped member 1 includes cross-marks 23 at pre-measured spaced apart intervals of one inch starting from the free end 4 and extending inwardly of leg 3 for about twelve inches. The cross-marks 23 enable a golfer to adjust the distance he stands from a golf ball 11 placed on a tee 12 through one of the positioning holes 13 in the cross-arm 2, and to note that distance by identifying the particular cross-mark 23 by which he stands.

The positioning holes 13 are spaced apart in the embodiment shown and described herein a pre-measured distance of one inch from center to center.

Figure 5:
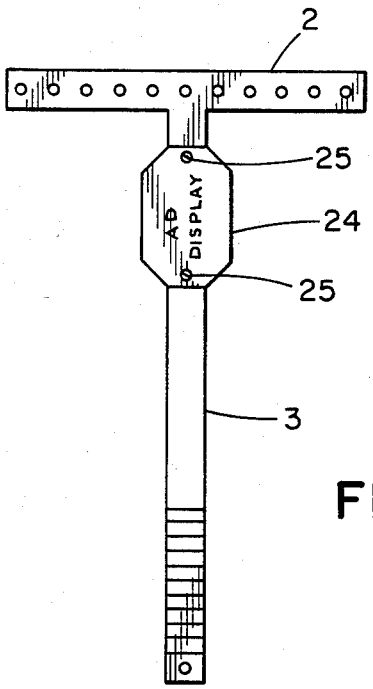
FIG. 5 is a plan view of a modified golf ball positioning device in accordance with this invention, having an advertising panel provided on the elongated leg of the T-shaped member.
Figure 6:
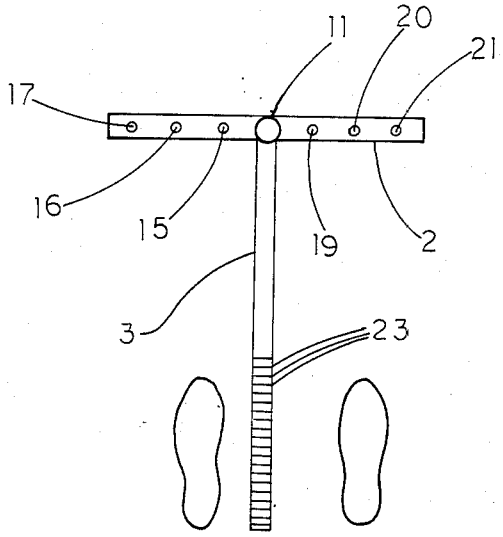
FIG. 6 is a plan view of the golf ball positioning device having a golf ball teed in the center-most hole and showing the foot position of a golfer who has a natural tendency to hit a slice shot when he uses his normal swing.
Figure 7:
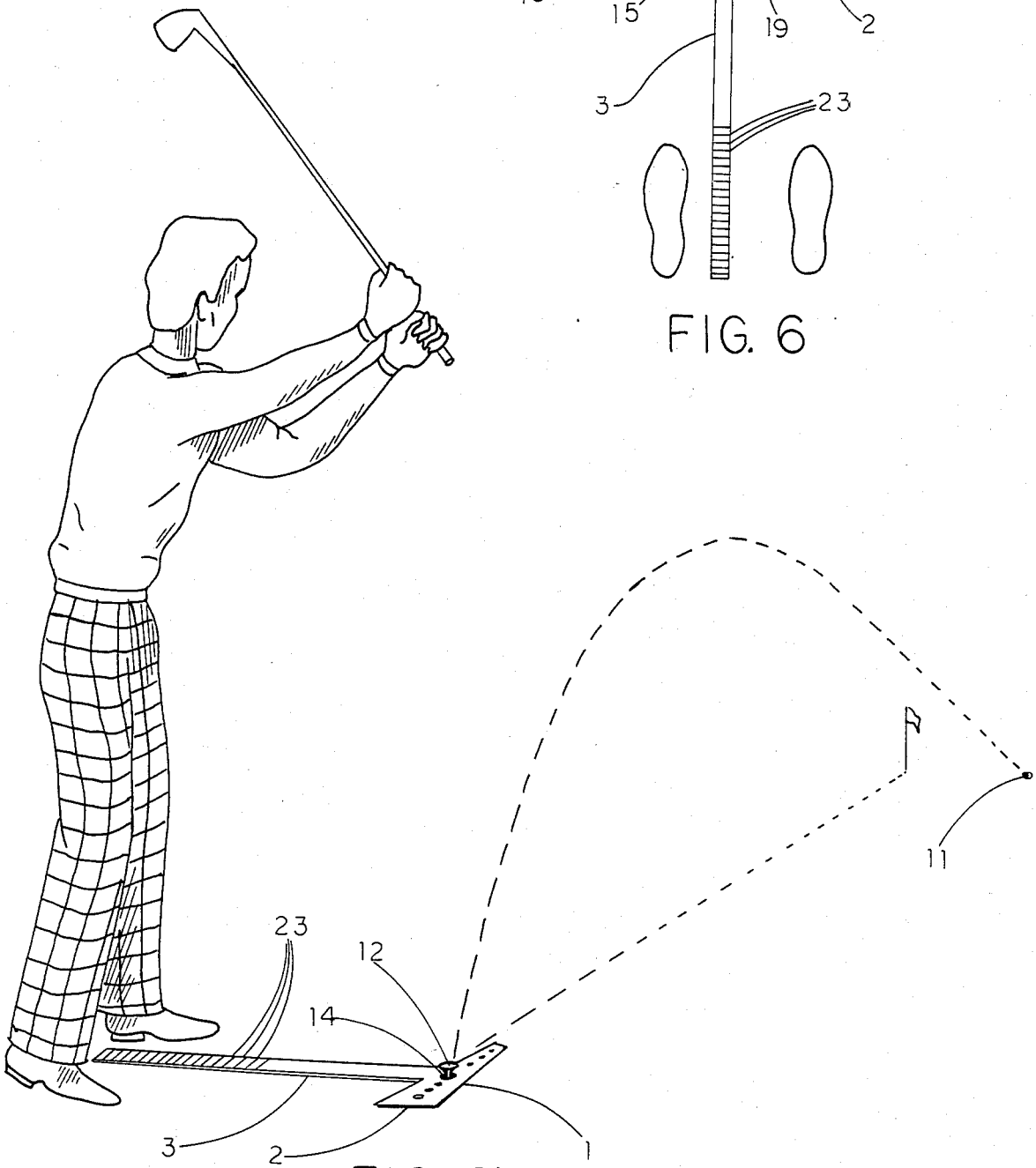
FIG. 7 is a perspective view of the golfer referred to in FIG. 6 showing him hitting a slice shot when the ball was teed up in the center-most hole of the positioning device.
Figure 8:
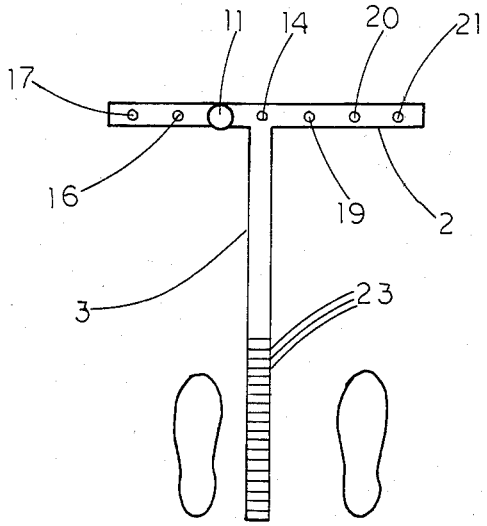
FIG. 8 is a plan view of the golf ball positioning device of FIG. 6 having the golf ball teed in the first hole forward of center and showing the foot position of the same golfer who has a natural tendency to hit slice shots when he uses his normal swing.
Figure 9:
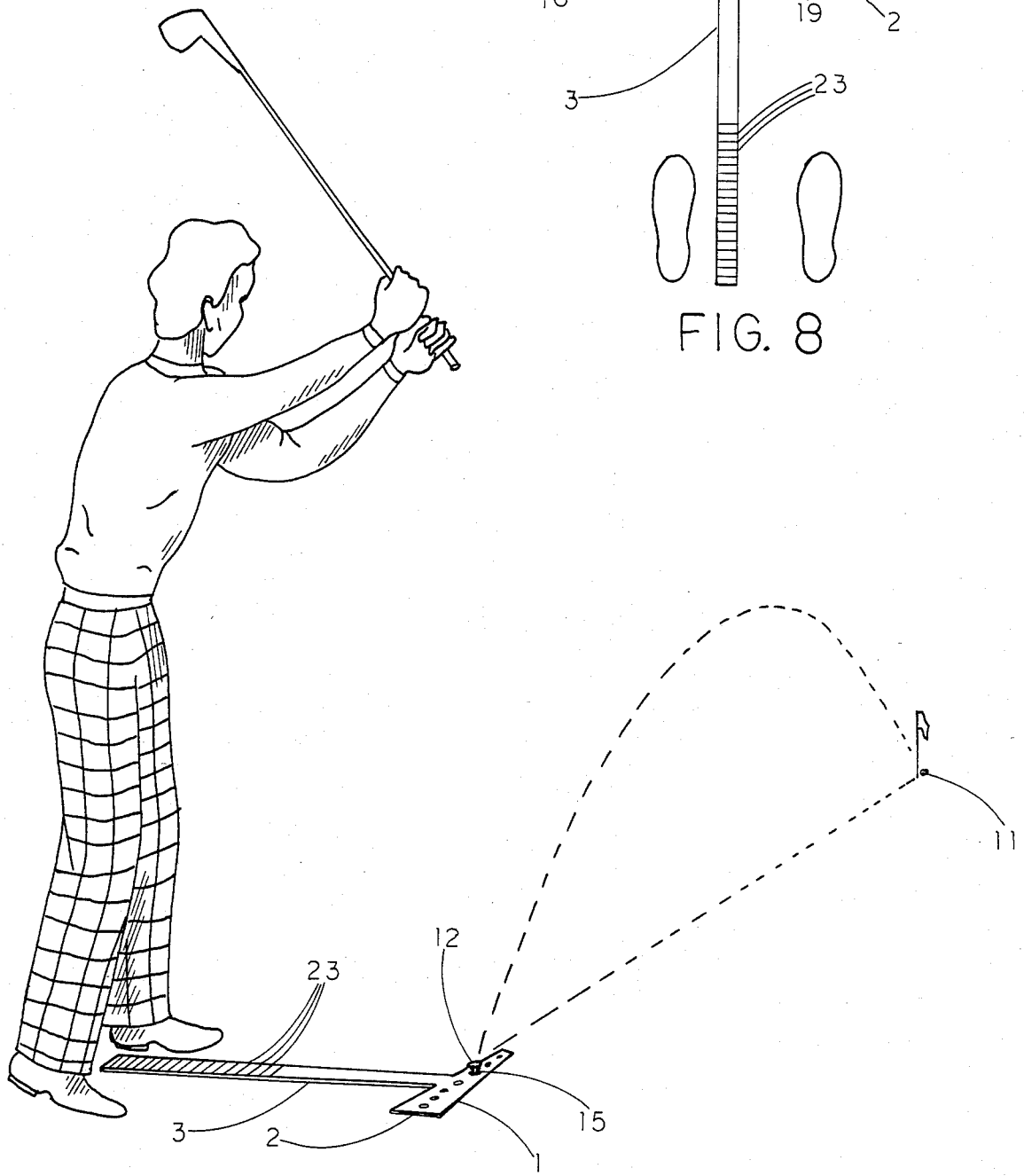
FIG. 9 is a perspective view of the same golfer referred to in FIGS. 6, 7 and 8 showing him hitting a straight shot directly toward the flag thereby correcting his tendency to slice by teeing the ball up in a hole of the positioning device forward of the center hole.
Figure 10:
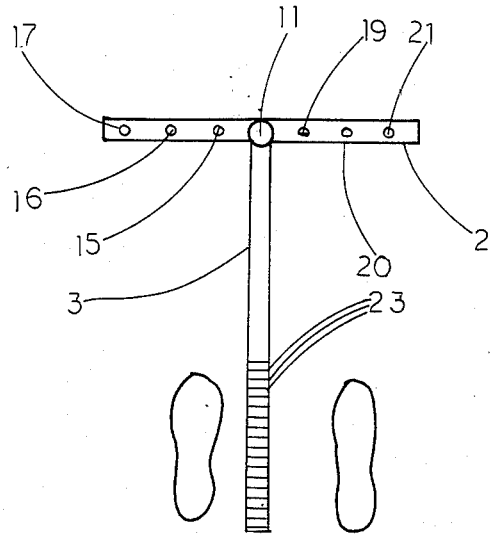
FIG. 10 is a plan view of the golf ball positioning device having a golf ball teed in the center-most hole and showing the foot position of a golfer who has a natural tendency to hit a hook shot when he uses his normal swing.
Figure 11:
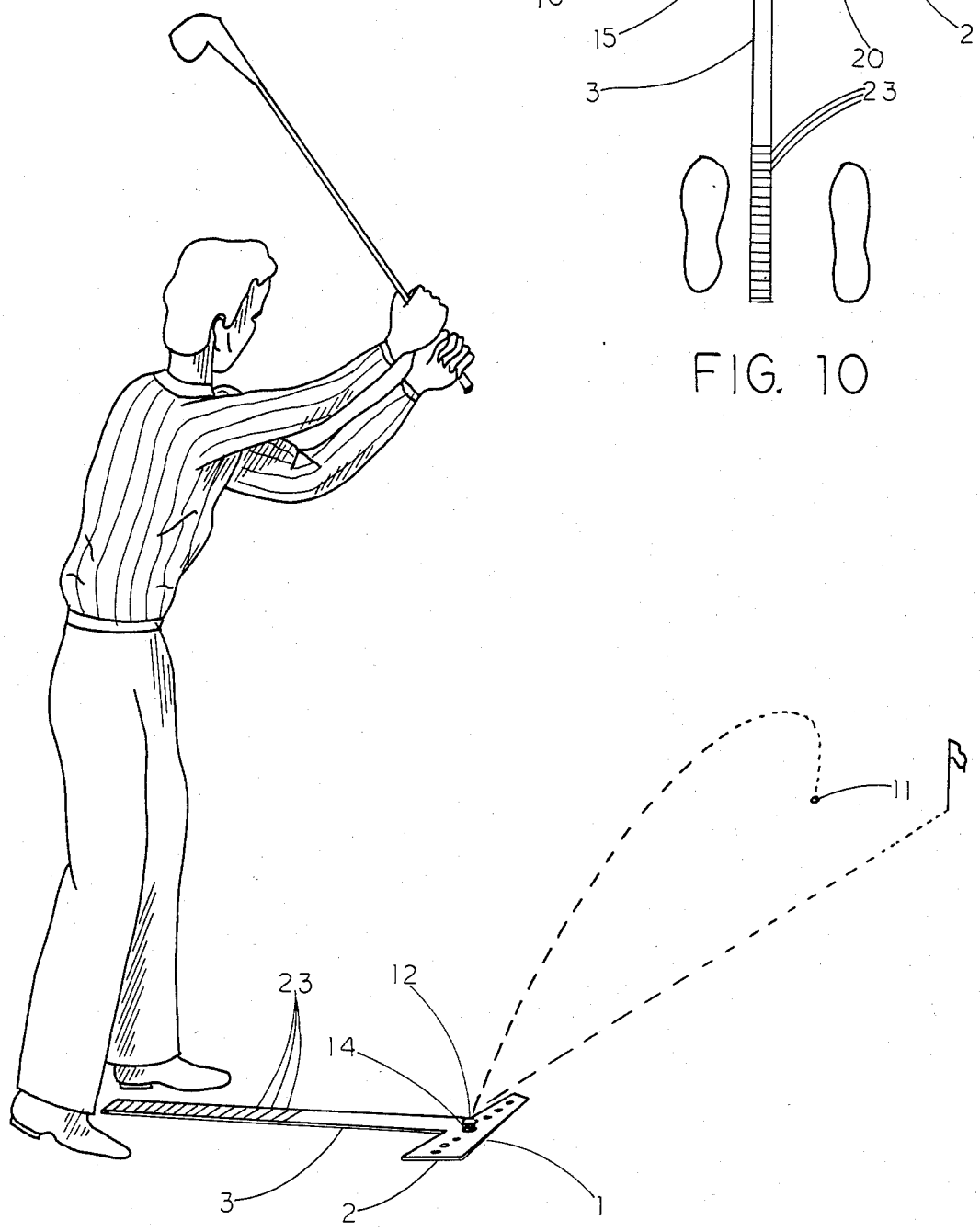
FIG. 11 is a perspective view of the golfer referred to in FIG. 10 showing him hitting a hook shot when the ball was teed up in the center-most hole of the positioning device.
Figure 12:
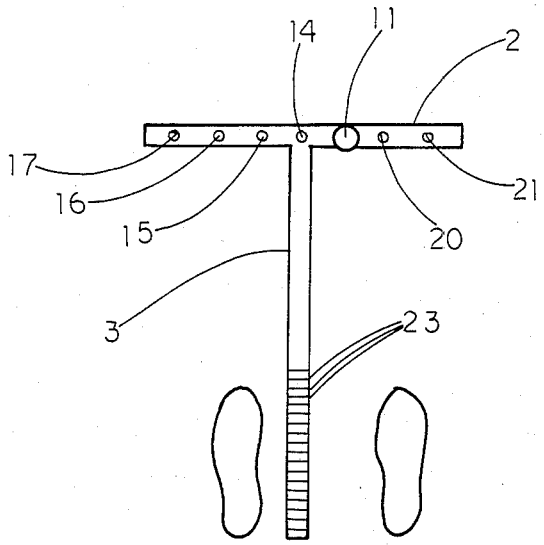
FIG. 12 is a plan view of the golf ball positioning device of FIG. 10 having the golf ball teed in the first hole rearward of center and showing the foot position of the same golfer who has a natural tendency to hit hook shots when he uses his normal swing.
Figure 13:
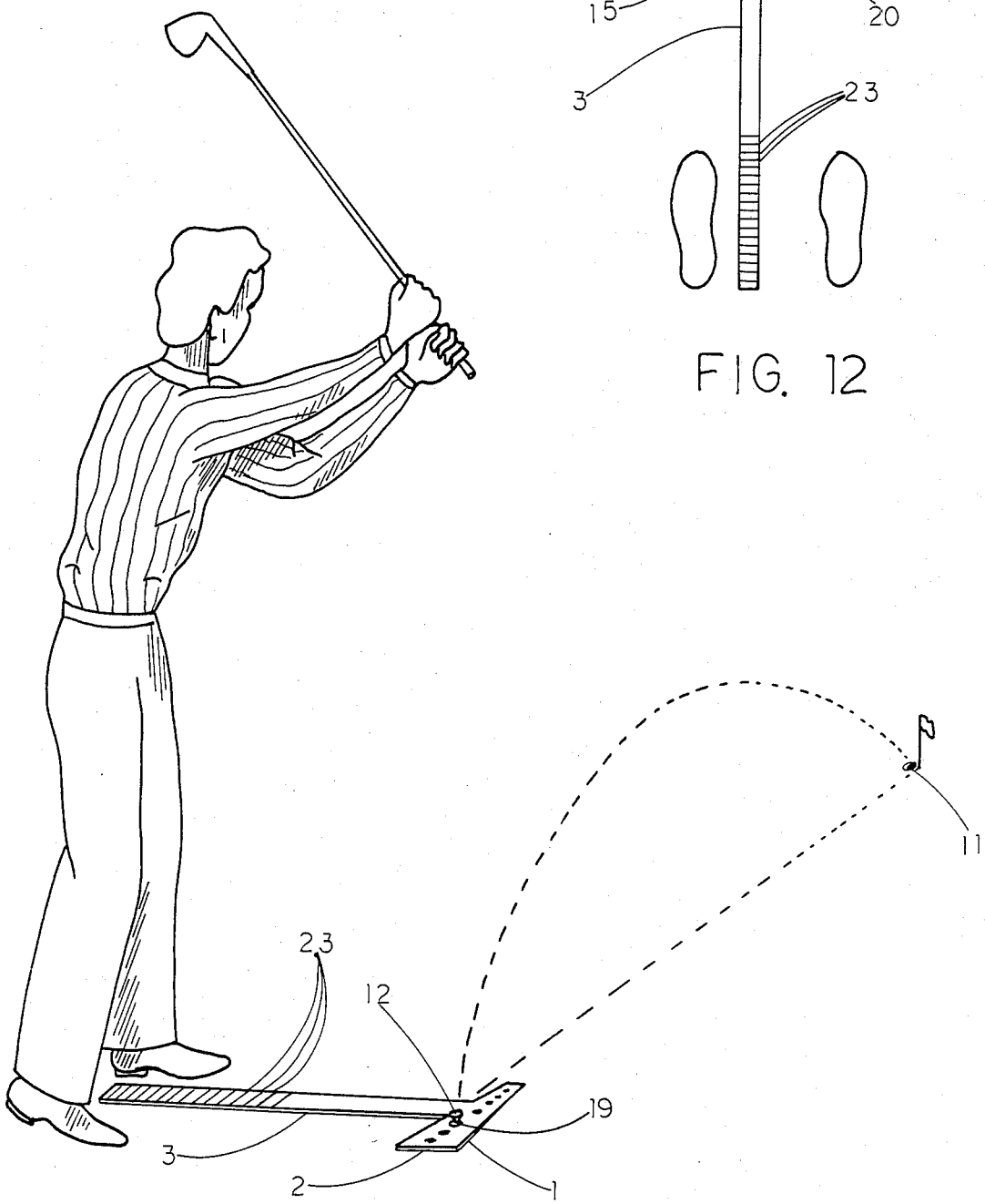
FIG. 13 is a perspective view of the same golfer referred to in FIGS. 10, 11 and 12 showing him hitting a straight shot directly toward the flag thereby correcting his tendency to hook by teeing the ball up in a hole of the positioning device rearward of the center hole.

In a modified form of the invention shown in FIG. 5, a panel 24 is provided on the elongated leg 3 on which advertising displays may be shown. The panel 24 is substantially wider in dimension than the width of the elongated leg 3. The panel 24 may extend for substantially the length of the leg 3 if desired, or for only a relatively short portion thereof. The panel 24 may be integrally formed with the leg 3, or may be separable from the leg 3 and attached thereto by clips, or bolts, or screws. The panel 24 shown in FIG. 5 is attached to the leg 3 in that embodiment of the invention by screws 25.

In use, a golfer would begin by pressing the T-shaped member 1 and its anchor pins 5 into the ground until the upper surface 8 of the T-shaped member is substantially coplanar with the surface of the ground. The cross-arm should be pointed in the general direction of the intended drive, and the elongated leg extending toward the position where the golfer will stand when ready to swing. For the first swing, the tee 12 should be placed through the center positioning hole 14 and the golf ball 11 placed thereon.

The golfer then takes a position with his legs astride the leg 3 of the T-shaped member 1 near the region of the free end 4, at a location he feels is a comfortable and appropriate distance from the ball 11 in placed as described. The golfer will then look at the particular cross-mark 23 on the leg 3 of the T-shaped member which is lined up with the back of his heel, and he will make a mental note identifying that particular cross-mark.

Figure 3:
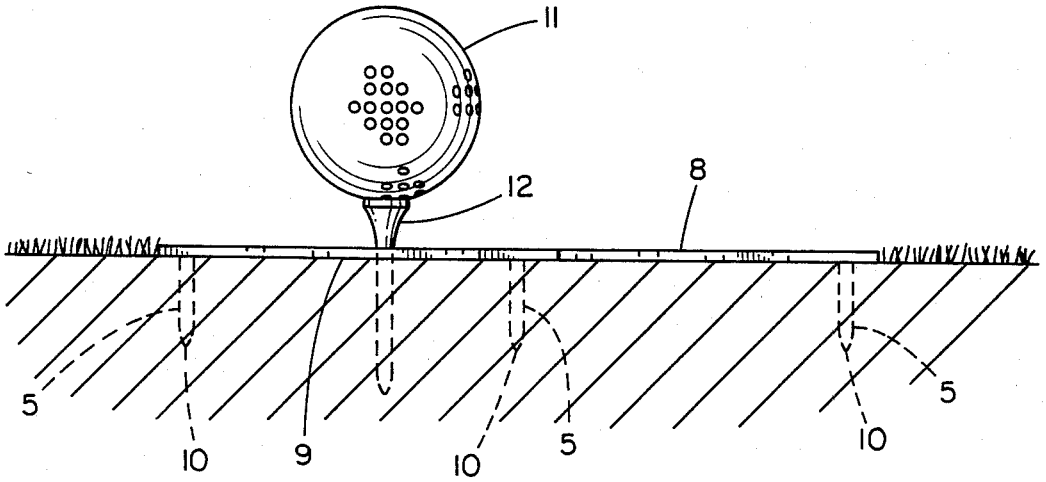
FIG. 3 is an end elevation view of the golf ball positioning device as shown in FIG. 2 but shown secured to the ground with the ground shown in a sectional view, and showing a tee through one of the forward positioning holes with a golf ball thereon.

The golfer then swings his club and hits the golf ball 11. If it slices toward the right, the tee 12 will then be placed in one of the forward positioning holes 15, 16, 17 or 18 for the next swing. If the slice was relatively moderate, the tee would for example be placed in the first forward positioning hole 15. If rather pronounced, the tee would be placed farther forward, for example in forward positioning hole 18. FIG. 3 illustrates a ball and tee 12 placed in a forward positioning hole to correct a slice.

The golfer then takes his next swing. If replacement of the ball as described corrects the problem, that position of the ball along the cross-arm 2 is noted and memorized by the golfer as well as his standing position relative to the cross-mark 23 along the leg 3 of the T-shaped member 1 which is adjacent to the back of his heel. When several drives are repeated with those positions marked by the T-shaped member 1, the golfer can then remove the positioning device and try to remember the correct position without that mechanical aid. In time the correct position will be imprinted in the golfer's mind, and the positioning device will not be needed until another problem with the golfer's swing occurs.

Figure 4:
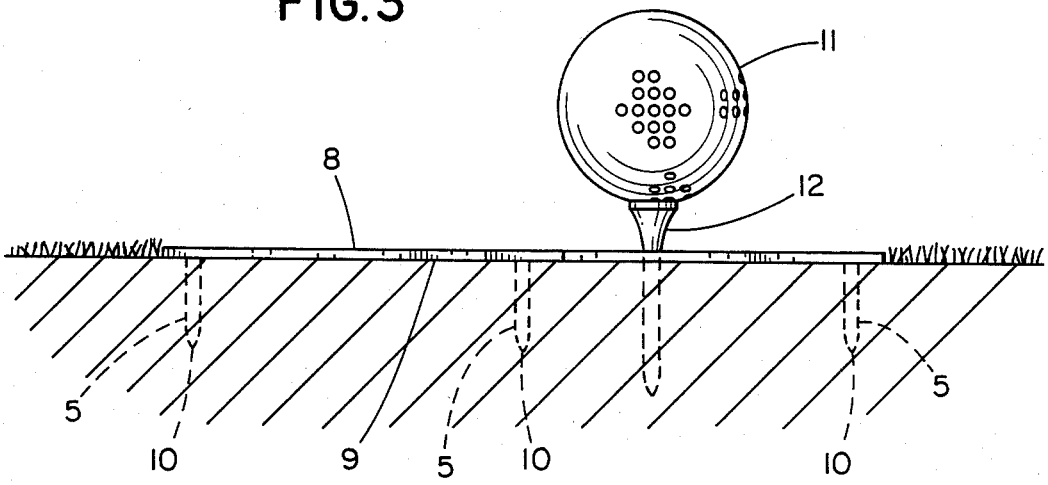
FIG. 4 is an end elevation view of the golf ball positioning device and ground in sectional view as shown in FIG. 3, but with the tee through one of the rearward positioning holes.

If when hitting the golf ball from the center positioning hole 14 results in a hook to the left, the tee 12 would then be placed in one of the rearward positioning holes 19, 20, 21 or 22. If the hook was relatively moderate, the tee would be placed perhaps only one hole back in rearward positioning hole 19. If the hook was more pronounced, the tee could be placed farther back, in rearward positioning holes 20, 21 or 22 depending on how pronounced the hook to the left was. The more pronounced the hook, the farther back the teel and ball should be placed. FIG. 4 illustrates a ball 11 and tee 12 placed in a rearward positioning hole to correct a hook.

Placing the ball 11 and tee 12 in the forward positioning holes 15, 16, 17 or 18 can also help to correct a swing which results in driving a ball too high. The farther forward, the higher the drive should become.

Placing the ball 11 and tee 12 in the rearward positioning holes 19, 20, 21 or 22 can also help to correct a swing which results in driving a ball too low, or perhaps topping the ball. The farther rearward, the lower the drive should become.

Obviously, there are other factors besides ball placement and distance from the ball which play a role in making correct drives and in correcting problems such as hooks, slices, too high or too low, and the like. How the club is gripped is one factor, keeping one's head down is another, left arm relatively straight another, follow through, relaxed stance, slightly flexed knees and so on. The tendency for many golfers who develop a problem with their drive is to subconsciously, or perhaps consciously, begin to change several of these variables with the result that nothing works, or if something finally does work, the golfer cannot accurately determine what it was specifically that he did right. The positioning device and method in accordance with this invention enables a golfer to methodically change one thing at a time, keeping all other things equal or unchanged. In other words, the hand grip of the club can be kept the same, the swing, follow through, degree of relaxation or stiffness, and so on which feels comfortable and natural for the golfer can be kept the same, and only the position of the ball relative to the golfer's stance can be changed, increment by increment to see what results are obtained from that single change. In most cases, changing that one factor of ball positioning relative to the place where the golfer stands will correct most problems. The ball positioning device and method in accordance with this invention as described and shown herein accomplishes that result.

This invention includes the method of positioning a golf ball to improve a golfer's swing, in which the exact distance of the golfer from the golf ball is determined and physically noted by the cross-mark 23 adjacent the back of the golfer's heel on the free end region of the elongated leg 3, the exact position of the ball on a line between where it lays and the spot where it is intended to be driven to is determined and physically noted by the positioning hole 14 in which the tee 12 is originally placed.

The ball is then hit. If it slices to the right, the tee 12 is placed in a positioning hole 15, 16, 17 or 18 forward of the original position and in line with the direction between the original ball placement and the originally intended target area or landing spot, thereby determining and physically noting the new position, after which the ball is hit again, repeating such forward repositioning process until the slice to right has been corrected. If the ball hooks to the left when it is first hit from the original positioning hole 14, the tee 12 is then placed rearward of the original position and in line with the direction between the original ball placement and the originally intended target area or landing spot, thereby determining and physically noting such new position intended to correct the hook to the left. The ball is then hit again, and the rearward repositioning process repeated until the hook to the left has been corrected. In every case, each new position is physically noted so the golfer can learn and recall the exact position to place the ball in order to make a drive without either a slice to the right or a hook to the left.

I claim:

1. A golf ball positioning device, comprising a unitary integrally formed planar member adapted to lie flat on the ground in substantially the same plane as the surface of the ground throughout its entire surface area, a plurality of spaced apart holes therein aligned in a first line which extends in the direction of intended flight of a golf ball when said positioning device is laid on the ground in position for use, including a first hole at one end of said line and a last hole at the other end of said line, a golf tee for placement through a selected one of said holes and into the ground when said positioning device is laid thereon, a golf ball for placement on said golf tee, a plurality of spaced apart marks on the surface of said planar member aligned in the direction of where the golfer will stand when in position to swing relative to where the said golf ball is placed at such time, said marks being aligned in a second line which extends in a direction which is substantially normal to the direction in which said holes are aligned, said spaced apart holes aligned in said first line which extends in one direction and said spaced apart marks aligned in a said second line which extends in a second direction which is normal to said first direction and being permanently fixed relative to each other in such a way that an in line extension of said second line intersects said first line at a point thereon between said first hole and said last hole, said planar member including a flat upper surface which is completely planar throughout its entire surface area, said planar member being of a rigid shape retaining material in the form of a T-shaped member having a cross-arm and an elongated leg extending from the midpoint of said cross-arm and normal thereto, said T-shaped member having a completely planar upper surface wherein the upper surfaces of said cross-arm and of said elongated leg are co-planar, said cross-arm and said elongated leg being integrally joined and permanently fixed relative to each other, said spaced apart holes being formed in said cross-arm, said spaced apart marks being formed on said elongated leg, said plurality of spaced apart holes includes at least one reference positioning hole as a normal position of reference, a first plurality of positioning holes positioned forwardly of said reference positioning hole in the said direction of intended flight, and a second plurality of positioning holes positioned rearwardly of said reference positioning hole also in the said direction of intended flight, said positioning holes having a diameter large enough to accept said golf tee therethrough.

2. A golf ball positioning device as set forth in claim 1, including anchor means to anchor said planar member to the ground and hold it securely in its original position when said golf ball positioned on said tee is driven therefrom.

3. A golf ball positioning device as set forth in claim 2, wherein said anchor means includes a plurality of anchor member positioned in triangular relationship.

4. A golf ball positioning device as set forth in claim 3, wherein said planar member comprises a T-shaped member including a cross-arm and an elongated leg extending from the midpoint of said cross-arm, said plurality of anchor members includes a first spike extending perpendicularly from one end region of said cross-arm, a second spike extending perpendicular from the opposite end region of said cross-arm, and a third spike extending perpendicular from the outer free end region of said elongated leg.

5. A golf ball positioning device as set forth in claim 1, wherein said elongated leg of said T-shaped member extends from said cross-arm a distance substantially equal to the distance a golfer normally stands from a golf ball when in position to swing at said golf ball.

6. A golf ball positioning device as set forth in claim 1, wherein said elongated leg of said T-shaped member is approximately forty-four inches in length, and said cross-arm is approximately ten inches long in the direction transverse to that of said elongated leg.

* * * * *